US006524085B2

(12) United States Patent
Shoda et al.

(10) Patent No.: US 6,524,085 B2
(45) Date of Patent: Feb. 25, 2003

(54) VENTING ARRANGEMENT FOR A SURFACE WASHER PUMP

(75) Inventors: Hirokazu Shoda, Isesaki (JP); Masakatsu Kimura, Ohta (JP)

(73) Assignee: Mitsuba Corporation, Kiryu (JP)

( * ) Notice: Subject to any disclaimer, the term of this patent is extended or adjusted under 35 U.S.C. 154(b) by 0 days.

(21) Appl. No.: 09/888,586

(22) Filed: Jun. 26, 2001

(65) Prior Publication Data

US 2002/0001528 A1 Jan. 3, 2002

(30) Foreign Application Priority Data

Jun. 29, 2000 (JP) ..... 2000-196592

(51) Int. Cl.[7] ..... F04B 17/00; F04B 35/04
(52) U.S. Cl. ..... 417/423.14; 417/423.11
(58) Field of Search ..... 417/423.11, 423.14, 417/432, 435

(56) References Cited

U.S. PATENT DOCUMENTS 3,802,807 A * 4/1974 Kilayko ..... 417/430
4,767,286 A * 8/1988 Kohl et al. ..... 310/63
4,905,904 A * 3/1990 Ohara et al. ..... 215/309
6,053,708 A * 4/2000 Nishikawa ..... 417/360
6,109,891 A * 8/2000 Sato ..... 417/423.1

FOREIGN PATENT DOCUMENTS

JP 62-20720 Y2 5/1987
JP 10-156197 * 12/1999 ..... B60S/1/48

* cited by examiner

*Primary Examiner*—Charles G. Freay
*Assistant Examiner*—Timothy P. Solak
(74) *Attorney, Agent, or Firm*—Oliff & Berridge, PLC

(57) ABSTRACT

The invention relates to a pump motor for a vehicle, wherein when integrally forming the housing of a motor pump, in which the pump accommodating portion is made larger in diameter than the motor accommodating portion, by using metal dies, ventilation holes that communicate from the base end side of the housing to the motor accommodating portion are formed without making the motor accommodating portion of the housing larger in diameter, wherein projections are formed so as to be continuous to the base end side at the portion opposed to the pump accommodating portion on the outer circumferential surface of the housing, and the ventilation holes are formed to incline inwardly so that they reach from the base end side of the projections to the inside of the motor accommodating portion.

18 Claims, 9 Drawing Sheets

VENTING ARRANGEMENT FOR A SURFACE WASHER PUMP

BACKGROUND OF THE INVENTION

1. Field of Invention

The invention relates to a pump motor for a vehicle used for the purpose of supplying a washer liquid to a wiper apparatus mounted in a vehicle.

2. Description of Related Art

Generally, in this type of a pump motor housing, there are some pump motor housings in which a motor chamber is formed at the tip end side (upper side) via a partitioning wall, and a pump chamber is formed at the base end side (lower side). In such a type pump motor housing, it is necessary to form a ventilation hole, by which the inner atmosphere communicates with the outer atmosphere in order to make the inner and outer atmospheric air pressure uniform, in the motor chamber, but, at the same time, not permitting water to flow in. Therefore, conventionally, such a motor housing having a ventilation hole, has been proposed which communicates from the pump chamber side, i.e., adjacent the side of the pump chamber but external thereto, located at the lower side of the pump motor housing to the upper side motor chamber, the inner and outer atmospheric air being exchanged while avoiding invasion of water into the motor chamber. Such a housing, for example, is found in JP-Y2-62-20720. In the utility model, a ventilation hole that reaches from the outer diametrical portion at the base end side of the housing to the motor chamber is formed so as to bypass the pump chamber, and the ventilation hole is further opposed to a through hole opened at the outer diametrical portion of a covering member that seals and encloses the pump chamber, wherein the inner and outer atmospheric air of the motor chamber are caused to communicate with each other through the ventilation hole and through hole.

In the case where a housing, in which the ventilation hole described above has been formed, is formed integral therewith by using metal dies, the ventilation hole will be formed by inserting a draft die for the ventilation hole from the base end side, being the pump chamber side of the housing, to the motor chamber side. Generally the draft die is inserted almost parallel to the cylindrical center of a rough cylinder that forms the outer diameter of the housing. Therefore, it is necessary that the outer diameter of the motor chamber be made larger than the outer diameter of the pump chamber so that the ventilation hole penetrates from the outer diametrical side at the base end side of the pump chamber to the motor chamber.

On the other hand, recently, it is desired that a higher discharge pressure be provided from the pump chamber while downsizing the motor. To meet the requirement, it becomes necessary that impellers of the pump chamber are made large to have a large diameter while downsizing the diameter of the motor chamber. Therefore, in a case where such a housing is integrally formed by using the above-described metal dies, because the ventilation hole is formed at the outer side of the pump chamber although the diameter of the pump chamber is made larger than that of the motor chamber, the housing must have a large diameter over the full length of at least the portion where the ventilation hole is formed, wherein a problem arises, which hinders the downsizing thereof. Further, in such a case, because the shape of the covering member that clogs the opening at the base end side becomes complicated, a problem is caused in which the sealing property of the pump chamber, which becomes the inner diametrical portion at the base end side, may be damaged. An object of the invention resides in this point.

SUMMARY OF THE INVENTION

The invention was developed in order to solve the above problems in view of the above-described situations. It is therefore an object of the invention to provide a pump motor for a vehicle accommodated in a housing in which a motor chamber supporting a motor shaft is formed at the tip end side thereof and a pump chamber is formed at the base end side thereof via a partitioning wall, wherein, when forming a ventilation port or hole for communicating the interior of the motor chamber with the exterior thereof for venting so that the ventilation hole bypasses the pump chamber from the base end side of the housing to enter the motor chamber, an outer hole opened to the base end side of the housing communicates with an inner hole that is located closer to the axial center of the motor shaft than is the outer hole and is opened to the interior of the motor chamber, that is, the ventilation hole has a slope from the outer hole to the inner hole such that the outer hole is further from the axial center than is the inner hole.

With such a structure, the outer diameter opposed to the motor chamber of the housing can be formed to be small.

In such a pump motor, the inner hole and outer hole are produced by using split type upper and lower metal dies, and the communication between the inner hole and outer hole is formed through the fitting surface between the upper and lower metal dies.

Therefore, the ventilation hole is formed so as to incline and reach from the base end side of a projection, which protrudes from and is formed at the outer circumferential surface of the housing, opposite to the pump chamber, to the interior of the motor chamber.

Further, in this type of housing, a plurality of ventilation holes are formed in the circumferential direction of the housing, the respective ventilation holes are parallel to each other, and are formed in parallel to a plane passing through the motor shaft and a point midway between the outer holes of the ventilation holes.

Still further, in this type of housing, the projection according to the invention is formed adjacent to the circumferential direction with respect to an intake hole formed so as to protrude outward from the outer circumferential surface of the housing.

Still further, in this type of housing, a sealing recessed groove, to seal the pump chamber, is formed at the base end side of the housing, an inclined recessed groove inclined toward the inner side is formed adjacent to the outside of the sealing recessed groove, and the ventilation holes are positioned at both ends in the circumferential direction of the inclined recessed groove and are formed along the inclination of the inclined recessed groove.

BRIEF DESCRIPTION OF THE DRAWINGS

The invention will be described with reference to the figures, in which.

DETAILED DESCRIPTION OF PREFERRED EMBODIMENTS

Figure 1:
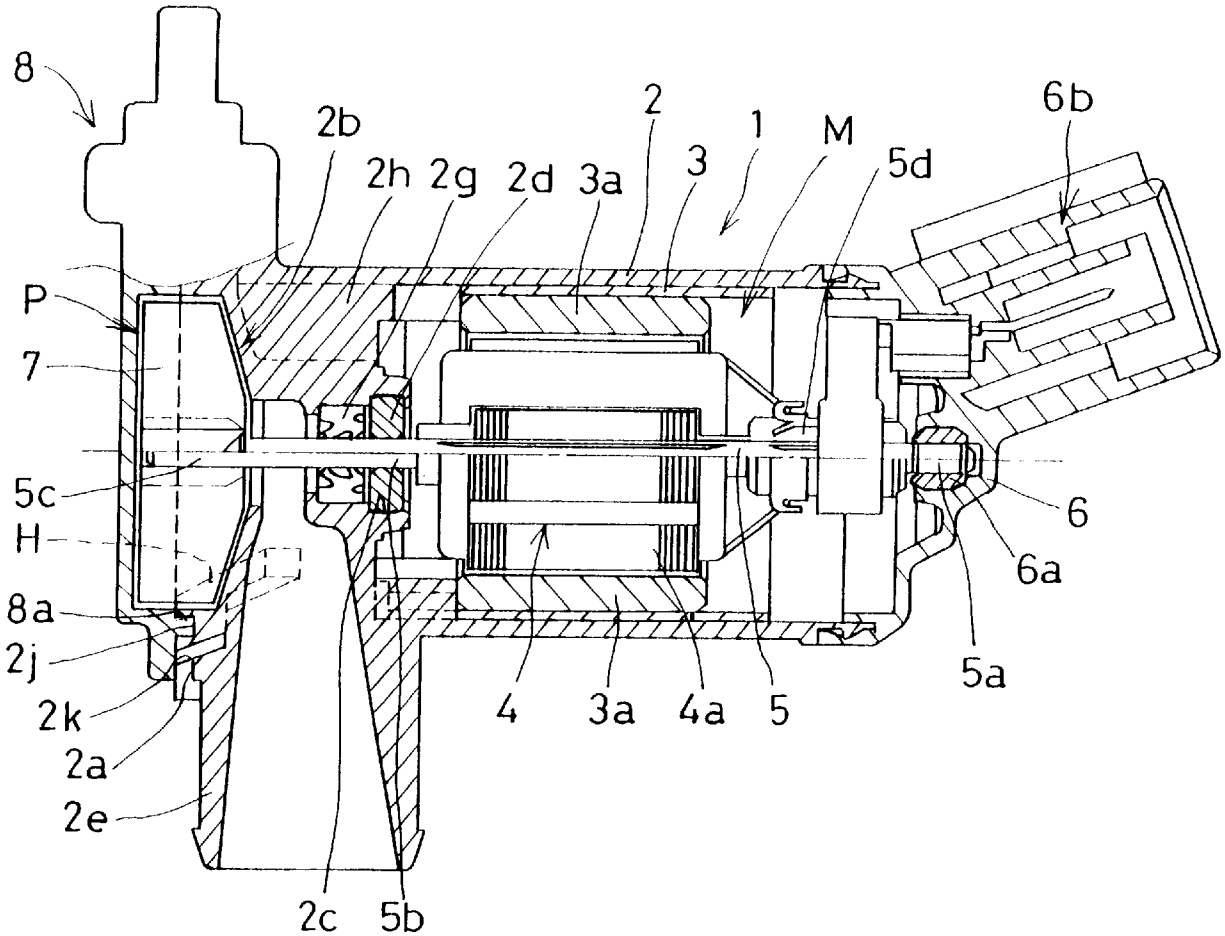
FIG. 1 is a front sectional view of a pump motor.
Figure 2:
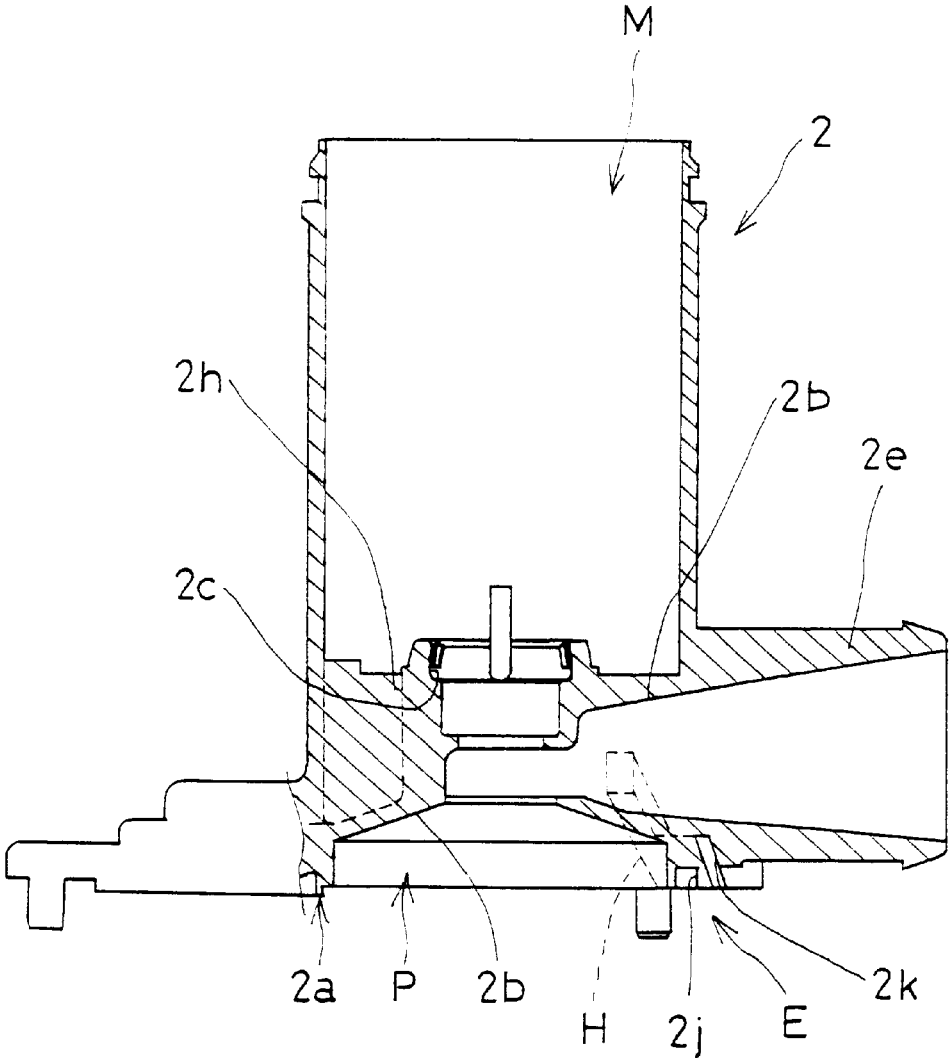
FIG. 2 is a front sectional view of the housing.
Figure 3:
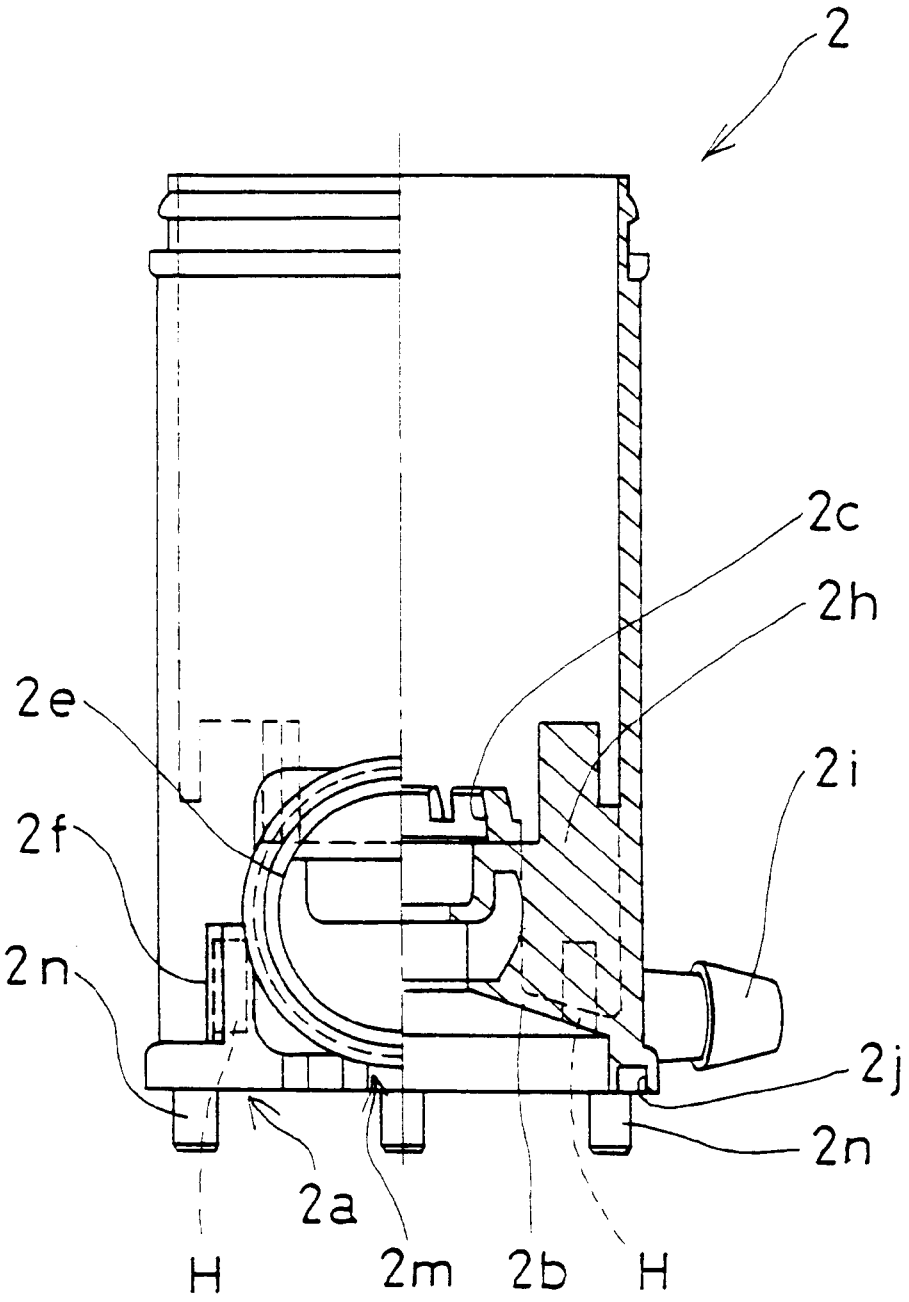
FIG. 3 is a side, partial sectional view of the housing.
Figure 4:
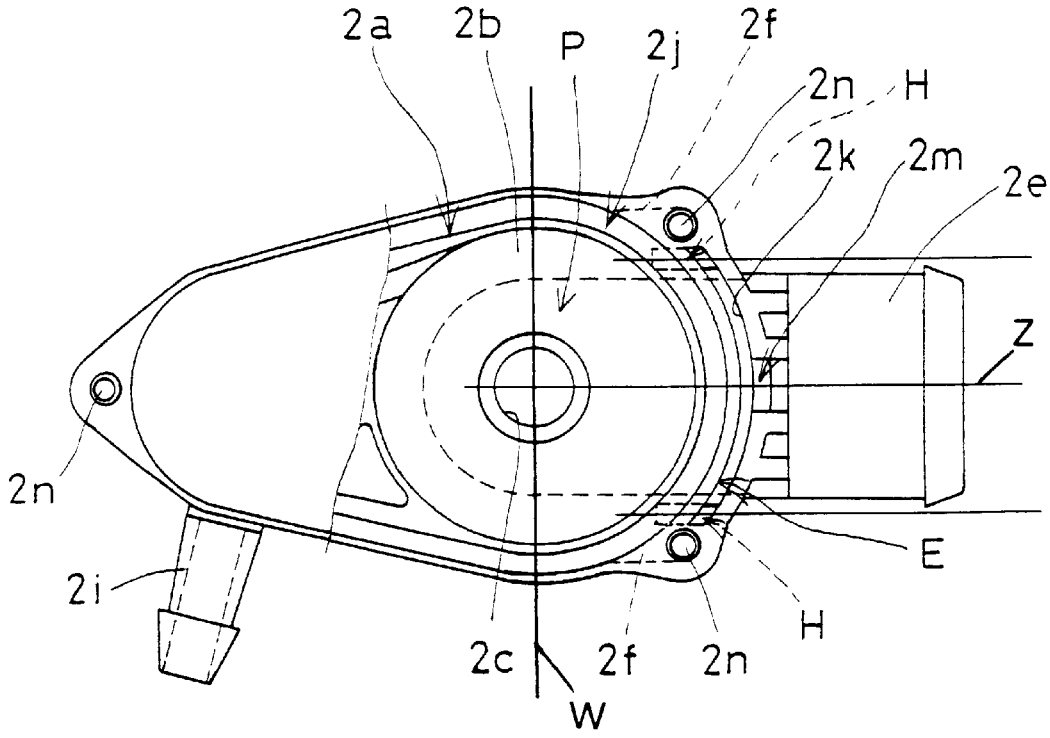
FIG. 4 is a bottom view of the housing.
Figure 5:
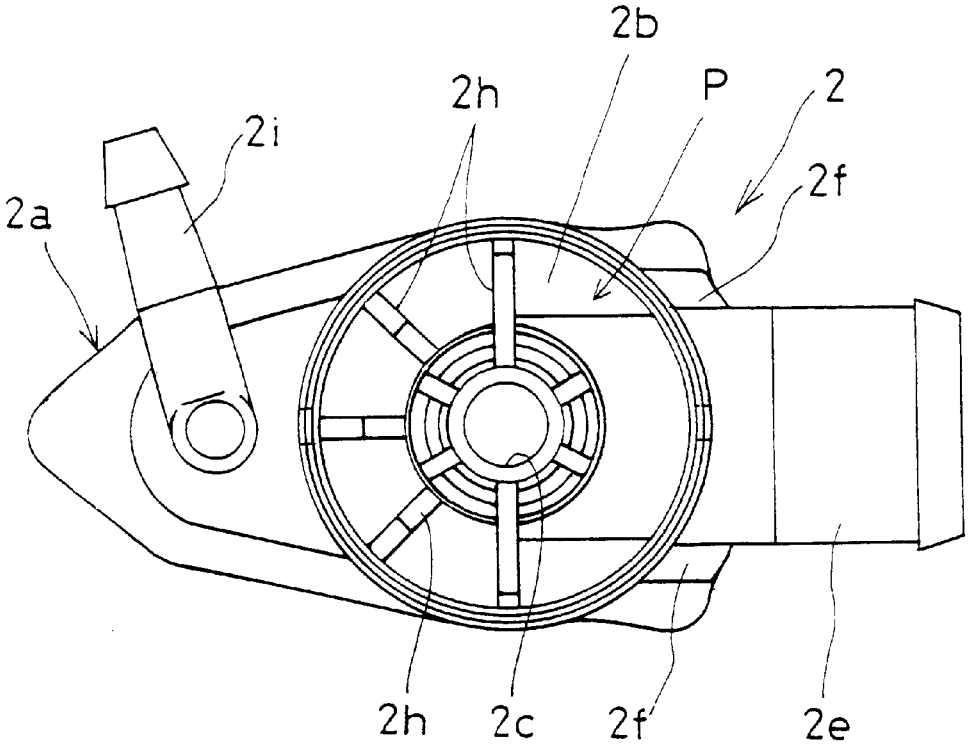
FIG. 5 is a plan view in a state where the front cover is removed from the pump motor of FIG. 1.
Figure 6A:
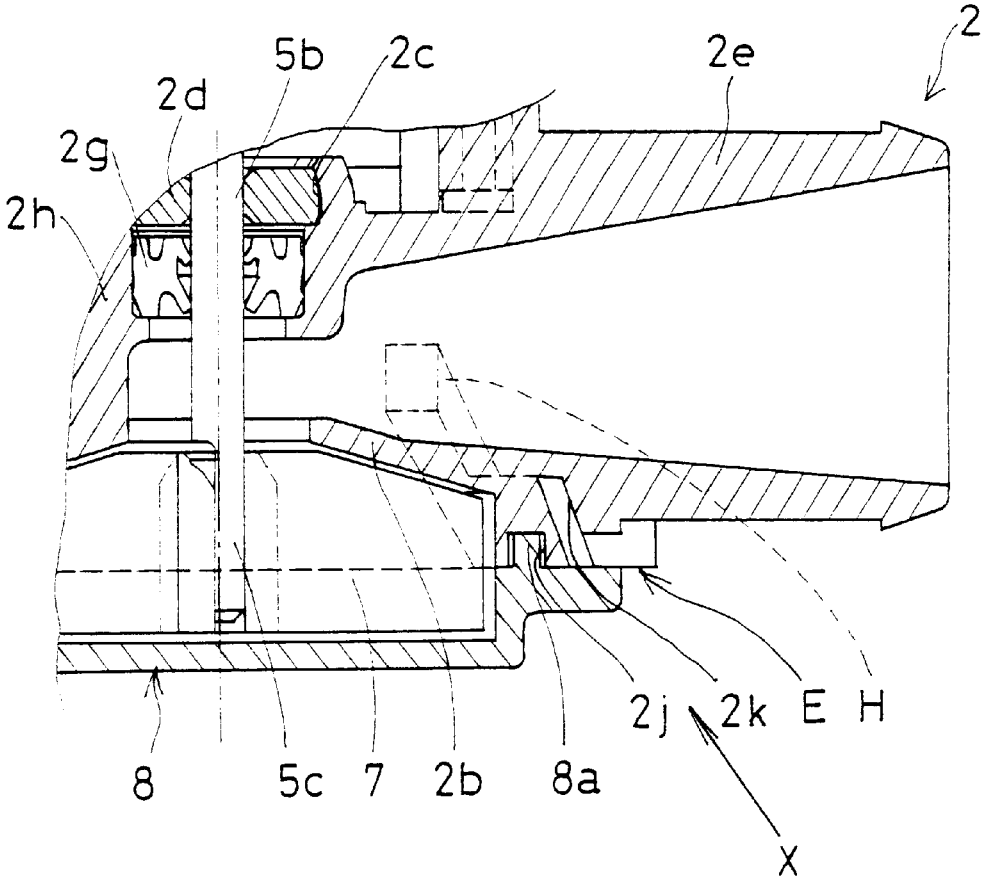
FIG. 6(A) is a partially front sectional view of the housing.
Figure 6B:
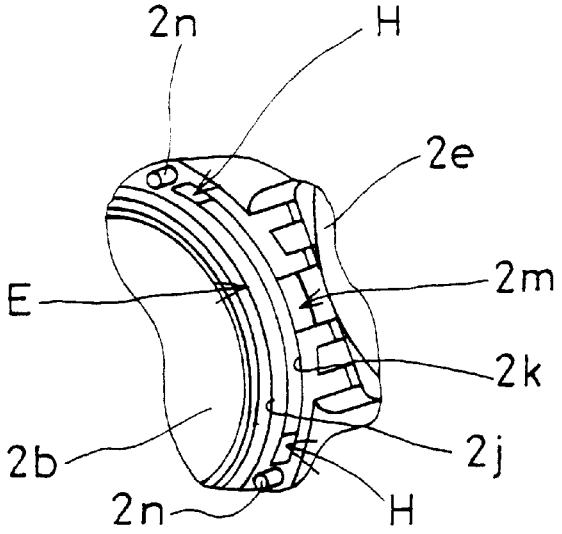
FIG. 6(B) is a view taken in the direction of the arrow X in FIG. 6(A)

Next, a description is given of a first embodiment of the invention on the basis of the accompanying FIGS. 1 through 6.

In the drawings, a pump motor 1 supplies a washer liquid in a washer tank (not illustrated) to washer nozzles provided at a wiper apparatus. A housing 2, in which the pump motor 1 is accommodated, is formed to be roughly cylindrical and is integrally formed using metal dies. In the housing 2, a funnel-shaped partitioning wall 2*b*, the tip end side of which is positioned deep in the cylinder in a state where it is continuous from the base end side thereof 2*a* (the end face, which is the underside of the housing 2 with the pump motor attached), whereby the tip end side is partitioned from the base end side. Relative to the partitioning wall 2*b*, the motor chamber M is set to be on the tip end side and the pump chamber P is set to be on the base end side. In the embodiment, the inner diameter at the motor chamber M side is set to be almost the same dimension as at the pump chamber P side.

A yoke 3 is integrally secured on the inner circumferential surface of the above-described motor chamber M, and a pair of permanent magnets 3*a* are attached to and fixed on the inner circumferential surface of the yoke 3. An armature 4 is disposed in a state where the outer circumferential surface of the armature core 4*a* is opposed to and in the vicinity of the inner circumferential surface of the permanent magnets 3. The tip end 5*a* of the armature shaft (motor shaft) 5, that constitutes the armature 4, is pivotally supported on a front cover 6, which covers the tip end of the housing 2, via a bearing 6*a*, and the intermediate portion 5*b* thereof is pivotally supported at a cylindrical pivotal supporting part 2*c*, which is formed at the partitioning wall 2*b*, via bearing 2*d*, wherein the armature 4 is supported so as to freely rotate in the motor chamber M. Also, a commutator 5*d* is fixed on the armature shaft 5, and an electric connection part 6*b* is formed integrally with the front cover 6.

The base end portion 5*c* of the armature shaft 5 protrudes from the pivotal supporting part 2*c* of the housing into the pump chamber P, and one-sided chamfering is employed at the base end portion 5*c* of the protruded armature shaft 5. The impeller 7 is attached to the one-sided chamfered part, and the impeller 7 is established so as to rotate integrally with clockwise and counterclockwise rotations of the armature shaft 5. Further, an intake port 2*e* that communicates with the pump chamber P side and sucks a washer liquid into the pump chamber P is formed so as to protrude outward in the vicinity of the base end side 2*a* at the outer circumferential surface of the housing 2. Thick (solid) projections 2*f* protrude from the outer circumferential surface of the housing 2, extend in a direction parallel to the axis of the armature shaft 5, and are formed so as to be continuous from the base end side 2*a* of the housing. The projections 2*f* are on the outer circumferential surface of the housing 2 and positioned at each side of the intake port 2*e* in the circumferential direction. The length of the projections 2*f* in the direction of the armature shaft 5 is made short so as to be set to a length which is slightly longer than the tip end side portion of the partitioning wall 2*b* that partitions the inside of the cylinder of the housing 2, and the motor chamber M side of the housing 2 remains cylindrical. Further, the section between the projections 2*f*, that is, the portion of the housing 2 surrounding, or adjacent to, the outwardly extending intake port 2*e* at the base end side surface 2*a* of the housing 2, is thickly formed and connects the projections 2*f* together. The portion of the housing 2 is thickened so that it protrudes outward from the base end to the intake port 2*e*, thereby forming a thick extension portion E. The thick extension portion E protrudes outward, partially surrounds the intake port 2*e* at the base end side surface 2*a* of the housing 2 and is lengthened in the circumferential direction between the projections 2*f*.

Also, a sealing member 2*g* is disposed at the base end side of the pivotal supporting portion 2*c*. The sealing member 2*g* is set so as to seal the pump chamber P and intake port 2*e* from the motor chamber M. In addition, a plurality of reinforcement ribs 2*h* are formed in the circumferential direction at the tip end side (motor chamber M side) of the partitioning wall 2*b*.

Further, the base end side 2*a* of the housing has a projection extending to the side opposite to the intake port 2*e* side (FIGS. 4 and 5), wherein a discharge port 2*i* is formed so as to protrude outward, and a washer liquid sucked from the intake port 2*e* into the pump chamber P is transferred to the discharge port 2*i* side by the rotation of the impeller 7.

A sealing recessed groove 2*j*, that encloses the pump chamber P and seals the pump chamber P, as described later, is formed to be recessed at the outer diametrical portion at the base end side 2*a*. Further, an elongated inclined recessed groove 2*k* is formed to be recessed in the circumferential direction within the thick extension portion E and positioned outside the sealing recessed groove 2*j* in a state where the inclined recessed groove 2*k* is adjacent to the outer edge of the sealing recessed groove 2*j*. Herein, while the groove direction, or depth, of the sealing recessed groove 2*j* is oriented in the direction of the armature shaft 5 and formed in parallel thereto, the grove direction of the inclined recessed groove 2*k* is formed as an inclined groove with the groove inner side positioned closer to the armature shaft 5 and the groove opening side, at the base end side 2*a*, positioned further from the armature shaft 5, i.e., the inclined recessed groove 2*k* is inclined toward the inner diametrical side. In addition, a clearance portion 2*m* is positioned at a roughly central part in the circumferential direction of the housing surface at the underside of the intake port 2*e*, and is formed to be notched at the groove side piece (side wall) that constitutes the inclined recessed groove 2*k*.

Ventilation holes H are positioned at both ends, in the circumferential direction, of the inclined recessed groove 2*k*, that is, at the part where the projection 2*f* of the housing 2 is formed, and are opened along the direction of the inclined groove of the inclined recessed groove 2*k*. The ventilation holes H are formed by inserting the upper metal die H (to be described with the same reference symbol as that of the ventilation holes for the convenience of description), which is shown with broken lines in FIGS. 1 and 3, from the motor chamber M when molding a pump motor housing. That is, a lower metal die is inserted from the base end side 2*a* of the housing 2 in order to form the inclined recessed groove, and the upper metal die is inserted from the upper side (motor chamber M side) so that the upper metal die H, in which a pair of projections are formed opposite to the part where the projection 2*f* of the inclined recessed groove 2*k* is formed, is brought into contact with the corresponding lower metal die, whereby an outer hole opened in the base end side 2*a* of the housing and an inner hole opened inside the motor chamber M are caused to communicate with each other so that the ventilation hole H is formed. The ventilation hole H is formed so that the inner hole is located nearer to a plane W (FIG. 4) passing through the axial center of the armature shaft 5 than the outer hole, that is, the ventilation hole H is further inclined toward the inner side, actually towards the plane W passing through the axial center and transverse to the longitudinal axis of the intake port 2*e*, whereby the ventilation hole H is set so as to reach the motor chamber M, bypassing the pump chamber P. In addition, the above-described two ventilation holes H are formed by a pair of projections secured at the single upper metal die with respect to the lower metal die. Therefore, the direction of the respective ventilation holes H becomes parallel to the direction of the inclined recessed groove 2*k* so as to extend from the inclined groove, and are parallel to the plane Z passing through the armature shaft and through a point (A) between and equal distance from the ventilation holes H.

In the above-described structure, outer atmospheric air flows into the ventilation holes H through the clearance portion 2*m* formed at the groove side piece of the inclined recessed groove 2*k*, and then flows to the motor chamber M. Thus, the air passage is constructed to have a labyrinth-like structure so that the outer atmospheric air flowing through the clearance portion 2*m* does not directly enter the ventilation holes H, whereby water is prevented from invading the motor chamber M.

On the other hand, an end cover 8 covers the base end side 2*a* of the housing so that it itself is abutted against the base end side 2*a*. An engagement projection 8*a*, to seal the pump chamber P, is formed at the tip end side (upper side) of the end cover 8 so that it is fitted to the sealing recessed groove 2*j* at the housing 2 side along with the sealing material. Further, an engagement hole (not illustrated) is formed at three points in the circumferential direction, and each engagement projection 2*n* protruding from the base end side 2*a* of the housing is constructed so as to be fitted to and engaged in a one of the above-described engagement holes, thereby positioning the housing 2 and end cover 8.

Figure 9:
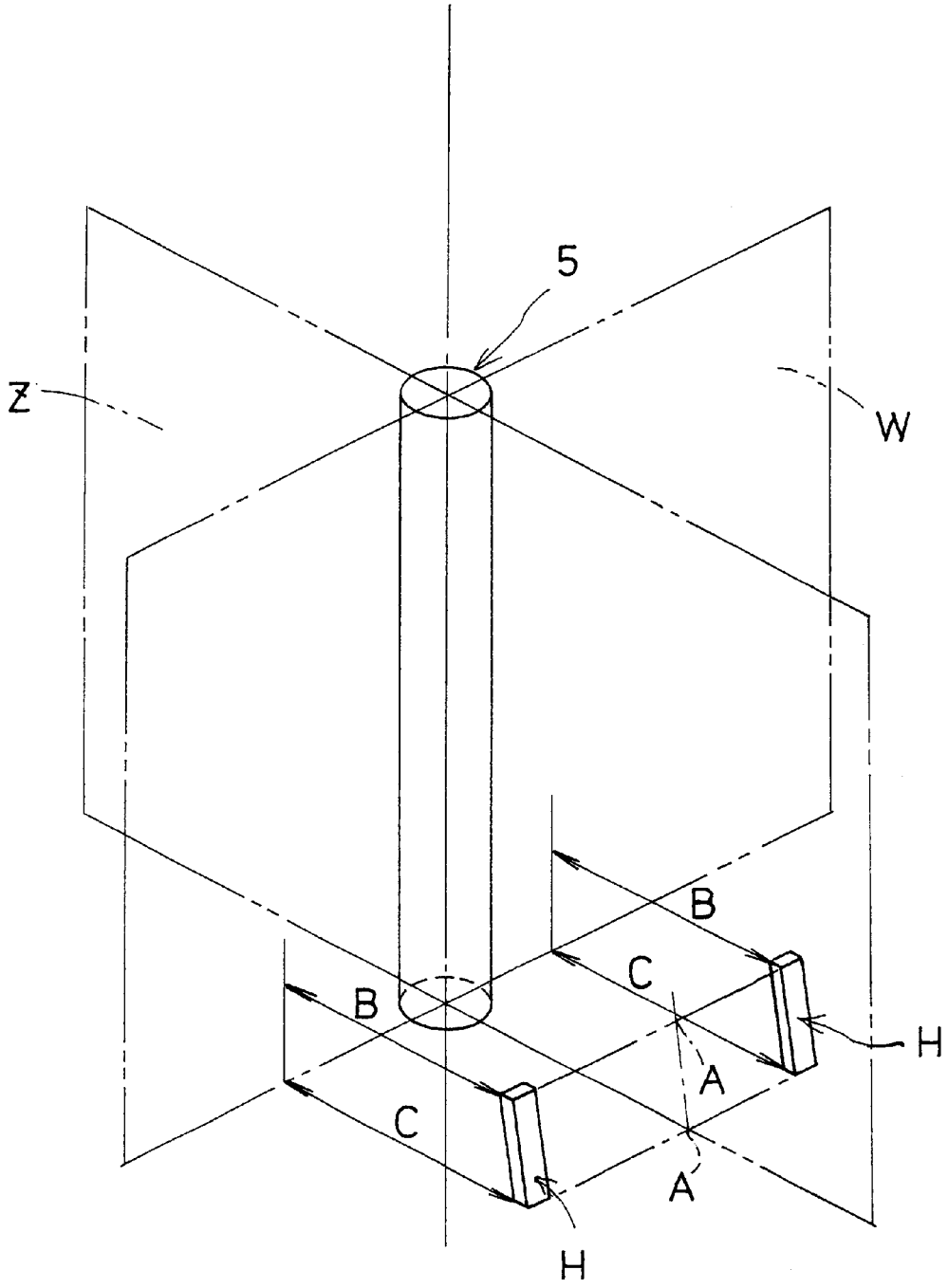
FIG. 9 shows schematically the relationship between the ventilation holes and the armature shaft.

In the embodiment of the invention, which is structured as described above, a washer liquid stored in a tank (not illustrated) is caused to flow from the intake port 2*e* of the pump motor 1 into the pump chamber P, and is discharged from the discharge port 2*i*. In such an embodiment, as described above, the ventilation with the outer atmospheric air into the motor chamber M is carried out by an air passage from the clearance portion 2*m* positioned and formed outside the base end side 2*a* of the housing to the inside of the motor chamber M through the inclined recessed groove 2*k* via the ventilation holes H. And, in this case, although the outer diameter of the pump chamber P is made roughly the same as that of the motor chamber M, the ventilation holes H are formed so that the projections 2*f*, formed on the outer circumferential surface opposed to the pump chamber P of the housing 2, become shorter in the direction of the armature shaft 5, the metal die H is inclined inwardly and inserted so as to reach from the base end side 2*a* to the inside of the motor chamber M at the projection 2*f*, and the inner hole of the ventilation hole H is positioned nearer to the plane W than the outer hole thereof (see FIG. 9). If B is the inner hole's distance to the plane W and C is the outer hole's distance to the plane W, then B<C. Therefore, the motor chamber M can be kept small in diameter and cylindrical at the tip end side part of the housing 2, that is, at the motor chamber M side, unlike the prior art type in which a metal die is inserted in parallel to the armature shaft to form ventilation holes, it is not necessary to make the housing large in diameter over the full length thereof, whereby the pump motor can be made compact.

Further, even in the case where the dimension of the outer diameter of the pump chamber P of the housing 2 has been made larger than the dimension of the outer dimension of the motor chamber M, projections 2*f* for forming ventilation holes H are integrally formed at the outer circumference of the housing 2 corresponding to the pump chamber P, and the upper and lower metal dies are inclined and inserted between the outer diameter side of and the inner diameter side of the motor chamber M at the corresponding projections 2*f*, whereby ventilation holes H in which the inner hole is positioned nearer to the plane W than the outer hole can be formed, and the outer diameter of the housing 2 can be kept small in diameter.

Furthermore, in this structure, because the projections 2*f* are formed so as to abut on the intake port 2*e* in the circumferential direction, which is formed at and protruded from the outer circumferential side of the cylinder of the housing 2, there is no inconvenience of a worsening of the space utility in attaching the pump motor 1 due to the formation of the projections 2*f* at the corresponding portion.

In addition, as described above, because the outer diameter of the housing 2 at the motor chamber M side is small in diameter and cylindrical in shape, the base end side 2*a* can be formed to allow the projections extending therefrom to be provided. By making the base end side 2*a* roughly elliptical, the overall width produced by the projections can be reduced. In such a case, the outer diameter of the end cover 8 can be formed to be elliptical, and reliability in the sealing of the pump chamber P and end cover 8 can be improved.

Additionally, because the motor chamber M side of the housing 2 is kept cylindrical, a sealing member may be circularly filled in the case where the front cover 6 and motor chamber M are assembled to be sealed, and automated sealing work can be further simplified.

Still further, because the embodiment is constructed so that, using the upper and lower metal dies, the fitting surfaces of the metal dies are devised to communicate the outer hole and the inner hole of the ventilation holes H with each other, the structure of the metal dies can be simplified without becoming complicated. In the above-described embodiment, the upper metal die is formed so as to abut on the lower metal die used to form the inclined recessed groove 2*k*, concurrent uses of metal dies can be achieved, thereby reducing the number of parts of the metal dies.

In addition, in the embodiment, a plurality of ventilation holes H are formed in the circumferential direction of the housing 2. However, in this case, because ventilation holes H, which are parallel to each other, and are formed by using a single metal die, further simplification of the metal dies can be achieved.

Also, the embodiment is structured so that outer atmospheric air flowing into the ventilation holes H is caused to flow in through the clearance portion 2*m* located at a roughly central position in the circumferential direction of the extension portion E formed at the outer diameter side of the base end side 2*a* of the housing, and reaches the ventilation holes H via the inclined recessed groove 2*k* in the circumferential direction. Therefore, the air passage is constructed with a labyrinth-like structure, wherein the waterproof feature can be made further excellent.

Figure 7A:
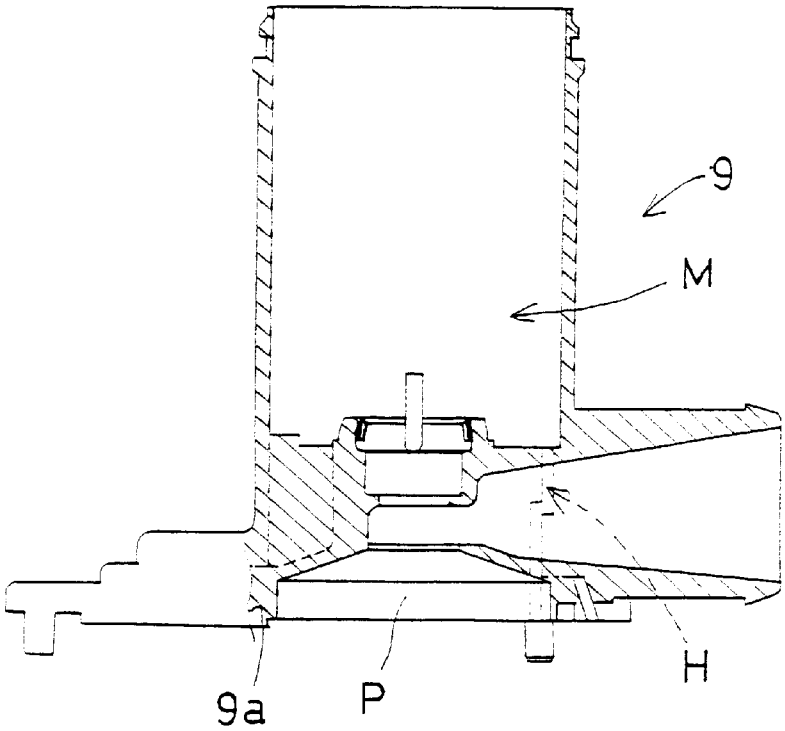
FIG. 7(A) is a front sectional view of the second embodiment.

Also, the present invention is not limited to the above-described embodiment. It may be constructed as in the second embodiment shown in FIGS. 7(A), 8(A) and 8(B).

Figure 8A:
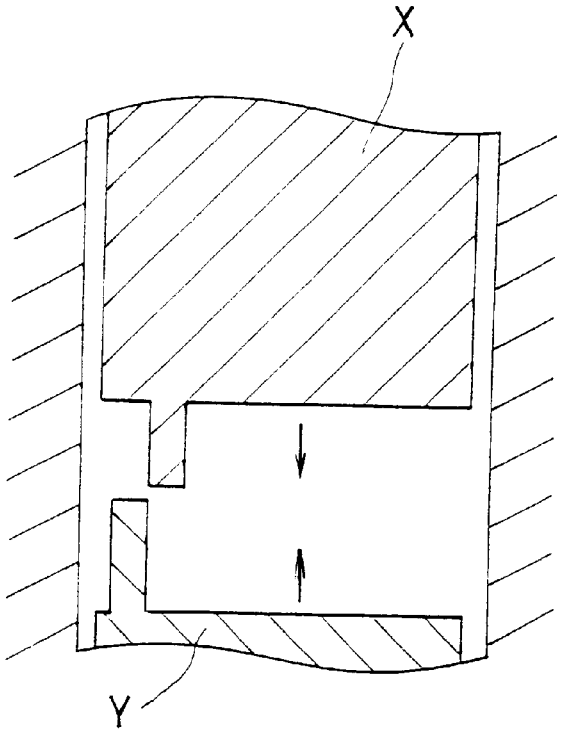
FIG. 8(A) is a sectional view showing the structure of metal dies of the ventilation holes according to the second embodiment in open position.
Figure 8B:
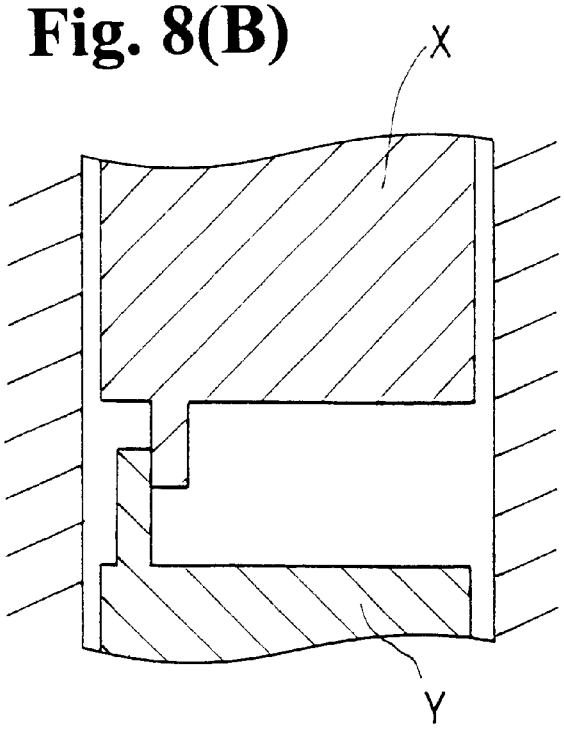
FIG. 8(B) is a sectional view showing the structure of metal dies of the ventilation holes according to the second embodiment in a closed position.

In the second embodiment, the ventilation holes H are folded like a crank. In this type, as shown in FIGS. 8(A) and 8(B), the ventilation holes are die-molded in a state where the planes X and Y of the upper and lower metal dies are brought into contact with each other (FIG. 8(B)), whereby the inner hole is positioned nearer to the axial center side of the motor shaft than the outer hole in the motor chamber M side and opened thereat while the outer hole is positioned at and opened at the outside (outer diameter) of the base end side 9*a* of the housing 9. In this case, the outer diameter of the motor chamber M can be kept small.

Figure 7B:
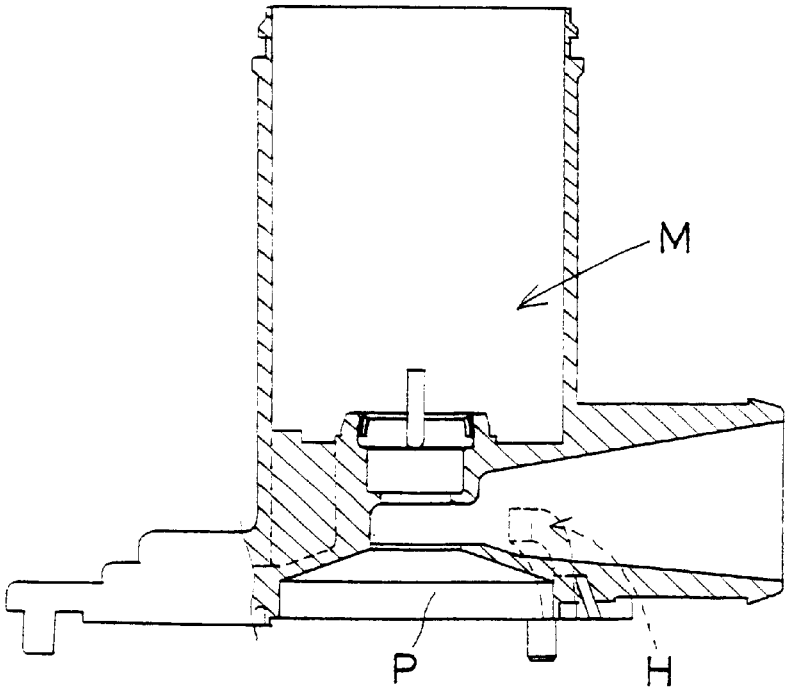
FIG. 7(B) is a front sectional view of the third embodiment.

Still further, the invention may be constructed as in the third embodiment as shown in FIG. 7(B). In the embodiment, the ventilation holes H are made like an circular arc, wherein the inner hole is positioned nearer to the axial center side of the motor shaft than the outer hole while the outer hole is positioned outside the base end side of the housing and opened thereat. In this case, the outer diameter of the motor chamber M can be kept small.

What is claimed is:

1. A pump for a vehicle accommodated in a housing in which a motor chamber supporting a motor shaft is formed at the tip end side thereof and a pump chamber is formed at the base end side thereof via a partitioning wall, said pump motor comprising at least one ventilation hole for communicating the interior of said motor chamber with the exterior thereof for venting so that said ventilation hole bypasses said pump chamber from the base end side of said housing to said motor chamber, wherein said ventilation hole is formed by communicating an outer hole opened to the base end side of said housing with an inner hole that is located closer to an axial center of said motor shaft than said outer hole and is opened to the interior of said motor chamber, wherein said ventilation hole is formed so as to incline and reach from the base end side of at least one projection, which is formed opposite to said pump chamber so as to protrude from the outer circumferential surface of said housing, to the interior of said motor chamber.

2. The pump for a vehicle as set forth in claim 1, wherein a plurality of ventilation holes are formed in the circumferential direction of said housing, and the respective ventilation holes are parallel to each other, and are formed in parallel to a plane passing through the motor shaft.

3. The pump for a vehicle as set forth in claim 2, wherein a projection is formed adjacent to the circumferential direction with respect to an intake port formed so as to protrude outward from the outer circumferential surface of said housing.

4. The pump for a vehicle as set forth in claim 3, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

5. The pump for a vehicle as set forth in claim 2, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

6. The pump for a vehicle as set forth in claim 1, wherein said projection is formed adjacent to the circumferential direction with respect to an intake port formed so as to protrude outward from the outer circumferential surface of said housing.

7. The pump for a vehicle as set forth in claim 6, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

8. The pump for a vehicle as set forth in claim 1, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

9. A pump for a vehicle accommodated in a housing in which a motor chamber supporting a motor shaft is formed at the tip end side thereof and a pump chamber is formed at the base end side thereof via a partitioning wall, said pump motor comprising at least one ventilation hole for communicating the interior of said motor chamber with the exterior thereof for venting so that said ventilation hole bypasses said pump chamber from the base end side of said housing to said motor chamber, wherein said ventilation hole is formed by communicating an outer hole opened to the base end side of said housing with an inner hole that is located closer to an axial center of said motor shaft than said outer hole and is opened to the interior of said motor chamber, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

10. The pump for a vehicle as set forth in claim 9, wherein said inner hole and outer hole are produced by using split type upper and lower metal dies, and the communication between said inner hole and outer hole is formed through the fitting surface between said upper and lower metal dies.

11. The pump for a vehicle accommodated in a housing in which a motor chamber supporting a motor shaft is formed at the tip end side thereof and a pump chamber is formed at the base end side thereof via a partitioning wall, said pump motor comprising at least one ventilation hole for communicating the interior of said motor chamber with the exterior thereof for venting so that said ventilation hole bypasses said pump chamber from the base end side of said housing to said motor chamber, wherein said ventilation hole is formed by communicating an outer hole opened to the base end side of said housing with an inner hole that is located closer to an axial center of said motor shaft than said outer hole and is opened to the interior of said motor chamber, wherein a plurality of ventilation holes are formed in the circumferential direction of said housing, and the respective ventilation holes are parallel to each other, and are formed in parallel to a plane passing through the motor shaft.

12. The pump for a vehicle as set forth in claim 11, wherein a projection is formed adjacent to the circumferential direction with respect to an intake port formed so as to protrude outward from the outer circumferential surface of said housing.

13. The pump for a vehicle as set forth in claim 12, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

14. The pump for a vehicle as set forth in claim 11, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

15. The pump for a vehicle accommodated in a housing in which a motor chamber supporting a motor shaft is formed at the tip end side thereof and a pump chamber is formed at the base end side thereof via a partitioning wall, said pump motor comprising at least one ventilation hole for communicating the interior of said motor chamber with the exterior thereof for venting so that said ventilation hole bypasses said pump chamber from the base end side of said housing to said motor chamber, wherein said ventilation hole is formed by communicating an outer hole opened to the base end side of said housing with an inner hole that is located closer to an axial center of said motor shaft than said outer hole and is opened to the interior of said motor chamber, wherein a plurality of ventilation holes are formed in the circumferential direction of said housing, and the respective ventilation holes are parallel to each other, and are formed in parallel to a plane passing through the motor shaft; and the inner hole and the outer hole are produced by using split type upper and lower metal dies, and the communication between the inner hole and the outer hole is formed through the fitting surface between the upper and lower metal dies.

16. The pump for a vehicle as set forth in claim 15, wherein a projection is formed adjacent to the circumferential direction with respect to an intake port formed so as to protrude outward from the outer circumferential surface of said housing.

17. The pump for a vehicle as set forth in claim 16, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

18. The pump for a vehicle as set forth in claim 15, wherein a sealing recessed groove to seal said pump chamber is formed at the base end side of said housing, an inclined recessed groove inclined toward an inner diametrical side is formed adjacent to the outside of said sealing recessed groove, and said ventilation holes are positioned at both sides in the circumferential direction of said inclined recessed groove and are formed along the inclination of said inclined recessed groove.

* * * * *